US007771073B2

(12) United States Patent
Chen

(10) Patent No.: US 7,771,073 B2
(45) Date of Patent: Aug. 10, 2010

(54) LUMINOUS WATER BOTTLE

(75) Inventor: Ming-Chang Chen, Tainan Hsien (TW)

(73) Assignee: Co-Union Industry Co., Ltd. (TW)

( * ) Notice: Subject to any disclaimer, the term of this patent is extended or adjusted under 35 U.S.C. 154(b) by 245 days.

(21) Appl. No.: 12/037,978

(22) Filed: Feb. 27, 2008

(65) Prior Publication Data

US 2009/0213577 A1 Aug. 27, 2009

(51) Int. Cl.
*F21V 33/00* (2006.01)

(52) U.S. Cl. ..... 362/101; 362/605; 362/34

(58) Field of Classification Search ..... 362/101, 362/605, 34
See application file for complete search history.

(56) References Cited

U.S. PATENT DOCUMENTS 5,067,060 A * 11/1991 Sieracki ..... 362/101
6,086,216 A * 7/2000 Goldfarb ..... 362/101
6,511,196 B1 * 1/2003 Hoy ..... 362/101
7,422,339 B2 * 9/2008 Jordan ..... 362/34
2009/0039045 A1 * 2/2009 Chen ..... 215/6

* cited by examiner

*Primary Examiner*—Sandra L O'Shea
*Assistant Examiner*—Leah S Lovell
(74) *Attorney, Agent, or Firm*—Ostrolenk Faber LLP

(57) ABSTRACT

A luminous water bottle includes a bottle body, a lid, and a lighting assembly. The bottle body has a bottom wall, and a surrounding wall extending upwardly from a periphery of the bottom wall and cooperating with the bottom wall to define a space. The surrounding wall has an upper end opposite to the bottom wall. The lid is releasably engaged with the upper end of the surrounding wall. The lighting assembly is disposed at least partially in the space and includes a light-generating unit for generating and emitting light, and an illumination member for dispersing the light emitted by the light-generating unit.

8 Claims, 6 Drawing Sheets

LUMINOUS WATER BOTTLE

BACKGROUND OF THE INVENTION

1. Field of the Invention

The invention relates to a water bottle, more particularly to a luminous water bottle.

2. Description of the Related Art

People often carry their own water bottles outside their homes so that they may replenish their body fluids at any time. This is particularly true in recent times with the rising societal emphasis on recycling which encourages the public to cut down on using disposable plastic bottles and instead utilize their own refillable water bottles.

If an additional function could be given to such water bottles, the convenience of use thereof would be improved.

SUMMARY OF THE INVENTION

It is an object of the present invention to provide a water bottle having a mechanism that illuminates to thereby provide a decorative and lighting effect to the water bottle.

According to the present invention, a luminous water bottle includes a bottle body, a lid, and a lighting assembly. The bottle body has a bottom wall, and a surrounding wall extending upwardly from a periphery of the bottom wall and cooperating with the bottom wall to define a space. The surrounding wall has an upper end opposite to the bottom wall. The lid is releasably engaged with the upper end of the surrounding wall. The lighting assembly is disposed at least partially in the space and includes a light-generating unit for generating and emitting light, and an illumination member for dispersing the light emitted by the light-generating unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
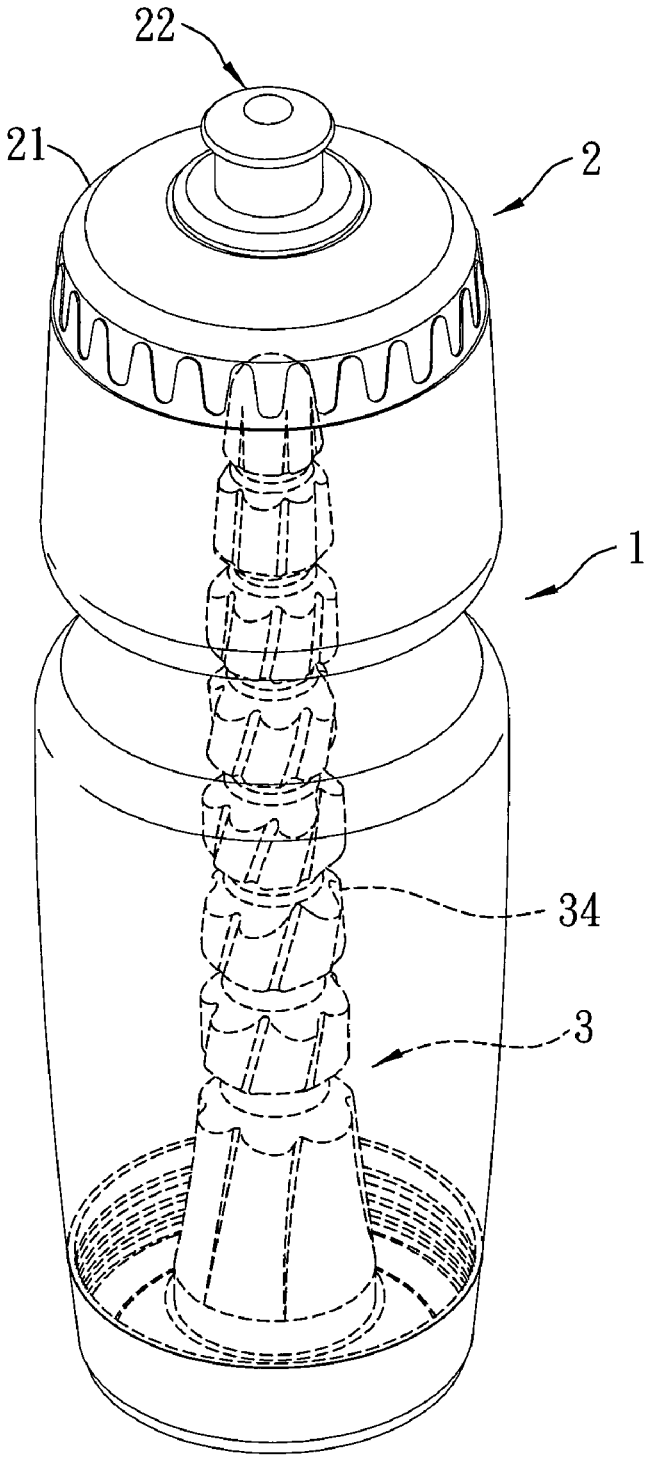
FIG. 1 is a perspective view of the preferred embodiment of a luminous water bottle according to the present invention.

Referring to FIGS. 1 to 5, the preferred embodiment of a luminous water bottle according to the present invention includes a bottle body 1, a lid 2, and a lighting assembly 3. The bottle body 1 has a bottom wall 13, and a surrounding wall 14 extending upwardly from a periphery of the bottom wall 13 and cooperating with the bottom wall 13 to define a space 10. The surrounding wall 14 has an upper end opposite to the bottom wall 13. The lid 2 is releasably engaged with the upper end of the surrounding wall 14.

The lighting assembly 3 is disposed at least partially in the space 10 and includes a light-generating unit 32 for generating and emitting light, and an illumination member 34 for dispersing the light emitted by the light-generating unit 32. In the preferred embodiment, the illumination member 34 is fabricated from an acrylic plastic material and is columnar in shape.

The illumination member 34 has a light-emanating surface 341 that is recessed to form at least one light-guiding surface 342, and a plurality of spaced-apart cutouts 343 vertically and slantingly formed on the light-emanating surface 341. The light-guiding surface 342 guides the light emitted by the light-generating unit 32.

The bottom wall 13 of the bottle body 1 includes an outer ring 151 extending upwardly from an inner surface of the bottom wall 13 into the space 10. The outer ring 151 has a stepped configuration to thereby form a ridge 154 on which the light-generating unit 32 is disposed. The bottom wall 13 of the bottle body 1 further includes an inner ring 152 extending upwardly from the inner surface of the bottom wall 13 into the space 10 and surrounded coaxially by the outer ring 151. The inner ring 152 defines a through-hole 155.

The light-generating unit 32 includes a support 321, a light-emitting element 322 disposed on the support 321, and circuit elements and connections (not shown) also disposed on the support 321. The support 321 has a container 323 with a lower end extending into the through-hole 155, and a flange 324 protruding radially from the container 323 and seated on the ridge 154. The light-emitting element 322 is disposed on the flange 324. In the preferred embodiment, the light-emitting element 322 is a light-emitting diode (LED). Also in the preferred embodiment, the light-generating unit 32 includes more than one light-emitting element 322, such as a pair of the light-emitting elements 322.

The lighting assembly 3 further includes a base 31 assembled to the bottom wall 13 of the bottle body 1. The base 31 includes a cover portion 311 disposed under the inner ring 152, and a connecting portion 312 projecting upwardly from the cover portion 311 and into the through-hole 155. The connecting portion 312 includes a plurality of spaced-apart lugs 313 that engage the inner ring 152.

The outer ring 151 of the bottom wall 13 has an upper surface. The illumination member 34 has a bottom surface 344 that is connected to a bottom end of the light-emanating surface 341. One of the upper surface of the outer ring 151 and the bottom surface 344 of the illumination member 34 is formed with a tongue 153, and the other of the upper surface of the outer ring 151 and the bottom surface 344 of the illumination member 34 is formed with a groove 346 that engages the tongue 153. In the preferred embodiment, the upper surface of the outer ring 151 is formed with the tongue 153, and the bottom surface 344 of the illumination member 34 is formed with the groove 346.

The illumination member 34 further includes a hole-defining wall 345 extending upwardly from the bottom surface 344 thereof to define a recess 347 for receiving the light-generating unit 32.

A power source unit 33 is electrically coupled to the light-generating unit 32 to supply power thereto. The power source unit 33 may include a plurality of batteries 331 that are connected in series and that are disposed in a cavity 325 defined by the container 323.

Figure 2:
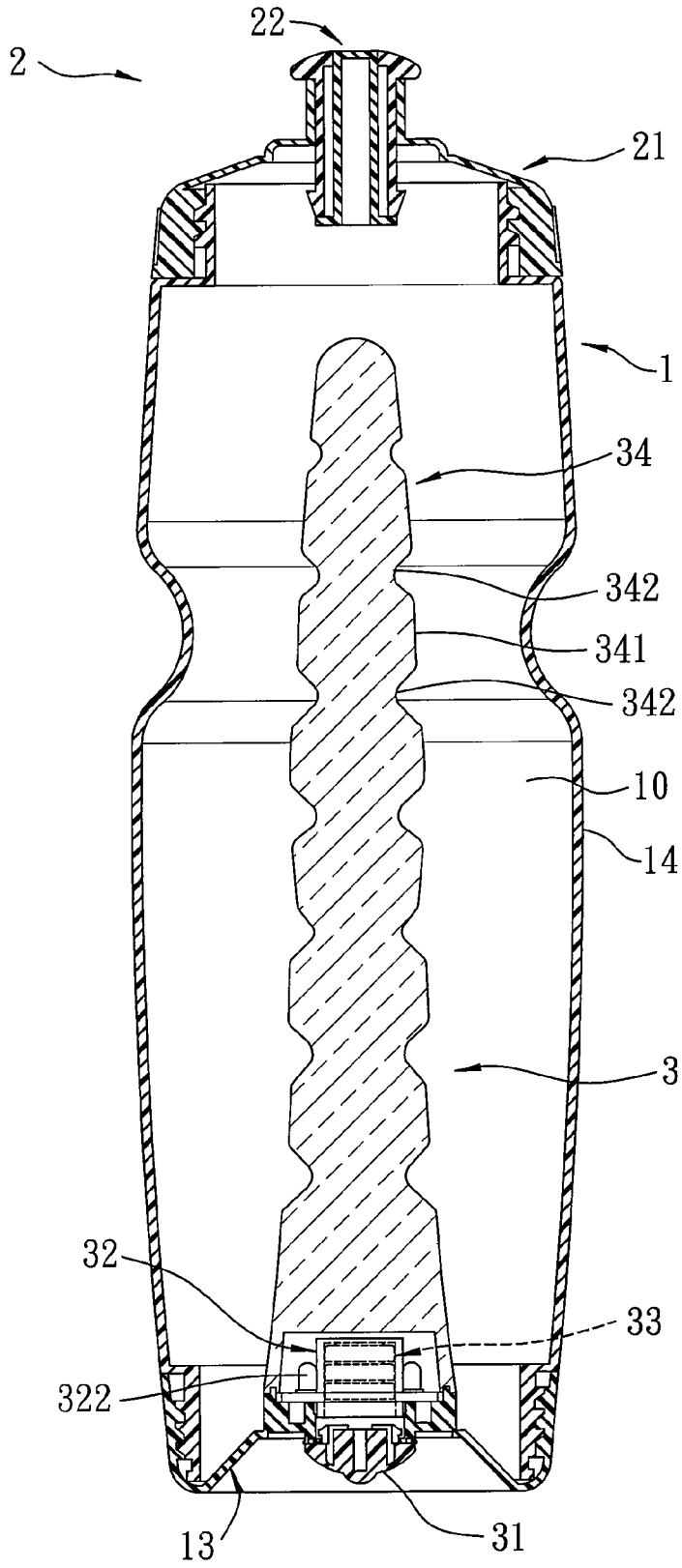
FIG. 2 is a sectional view of the preferred embodiment, illustrating a spigot of the luminous water bottle in a closed position.
Figure 6:
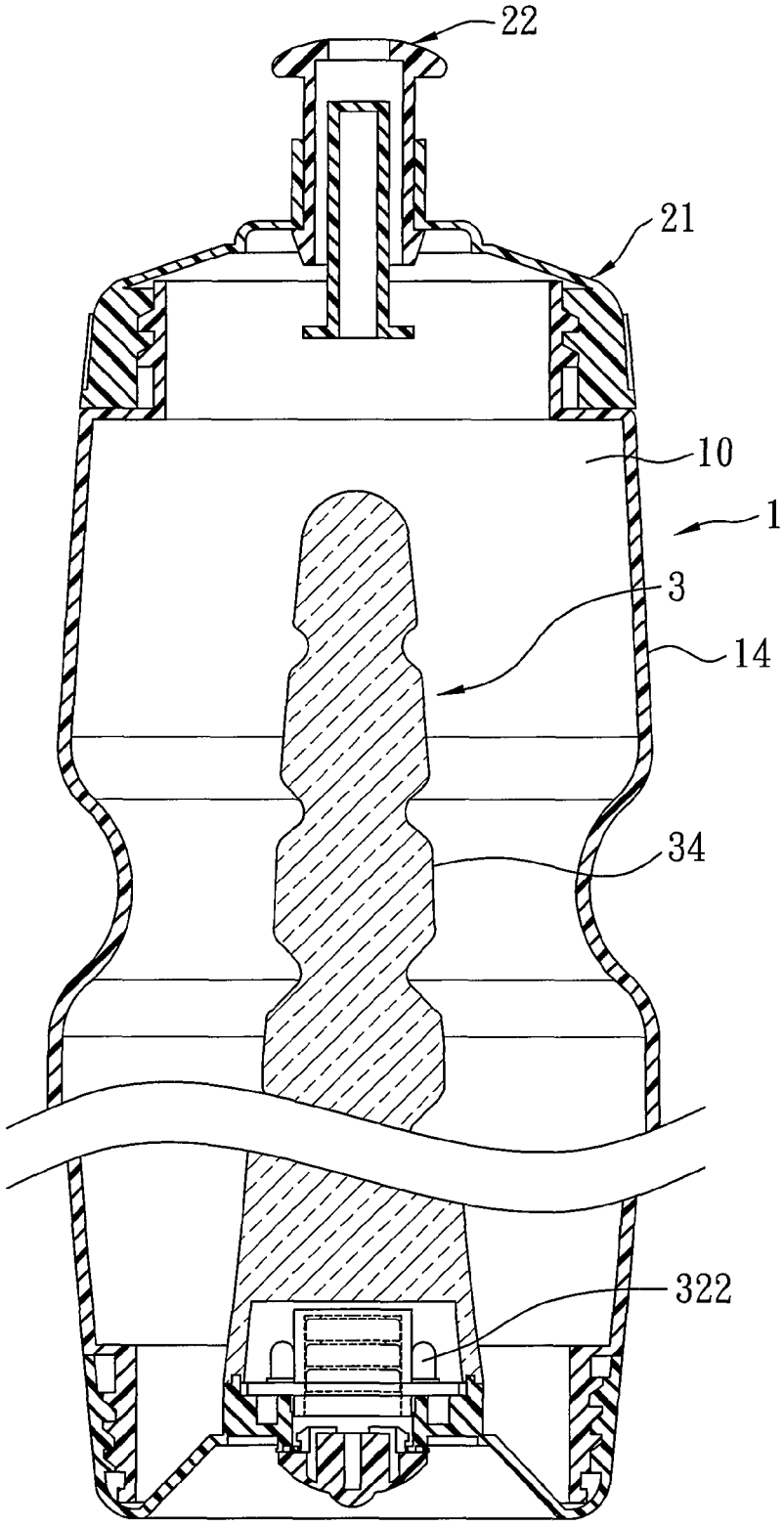
FIG. 6 is a fragmentary sectional view of the preferred embodiment, illustrating the spigot of the luminous water bottle in an open position.

Referring to FIGS. 1, 2, and 6, the lid 2 includes a cap portion 21 releasably engaged with the bottle body 1, and a spigot 22 disposed on the cap portion 21 and selectively operable to allow fluid to flow therethrough. That is, the spigot 22 is operable relative to the cap portion 21 between a closed position shown in FIG. 2, and an open position shown in FIG. 6. When the spigot 22 is at the closed position, the space 10 in the bottle body 1 is closed off from the outside environment. On the other hand, when the spigot 22 is at the open position, the space 10 in the bottle body 1 is communicated spatially with the outside environment, such that liquid can be dispensed from the space 10 in the luminous water bottle.

Figure 4:
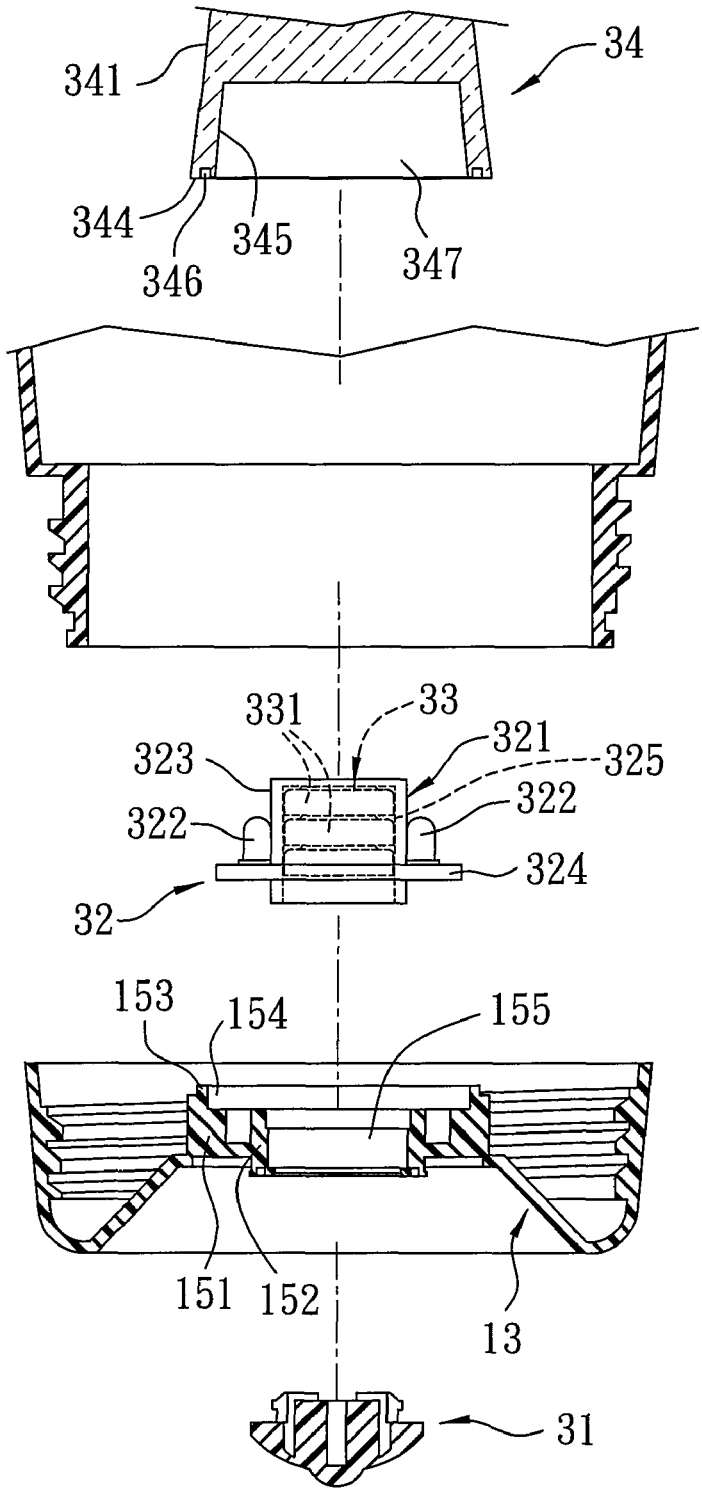
FIG. 4 is a fragmentary exploded sectional view of the preferred embodiment.
Figure 5:
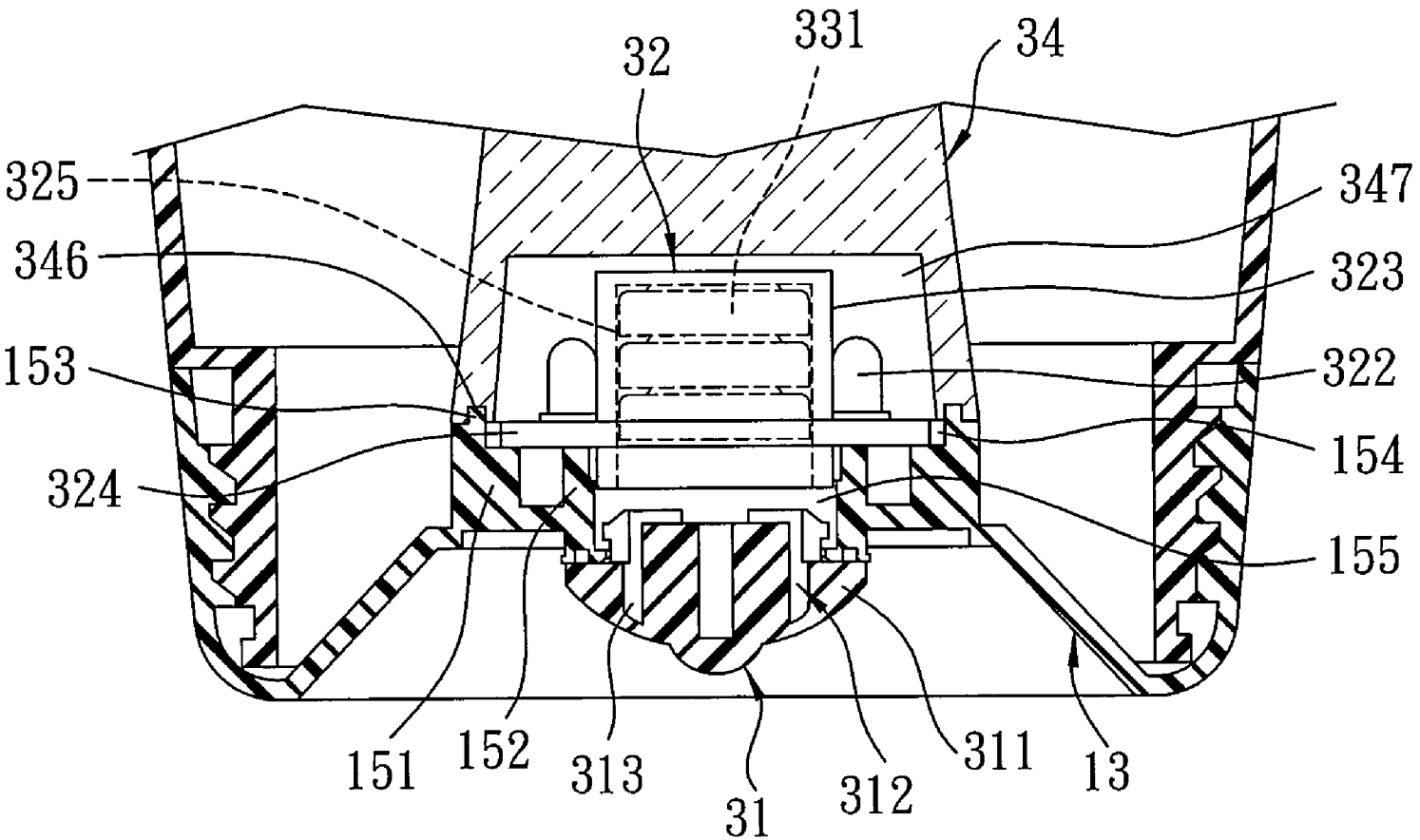
FIG. 5 is a view similar to FIG. 4, but illustrating elements of the luminous water bottle in an assembled state.

Reference is now made to FIGS. 1, 4, and 5. To assemble the luminous water bottle, the batteries 331 are placed in the cavity 325 of the light-generating unit 32. The flange 324 of the support 321 of the light-generating unit 32 is then placed on the ridge 154 of the outer ring 151 such that a bottom end of the container 323 is received in the through-hole 155. Next, the groove 346 of the illumination member 34 is engaged with the tongue 153 of the outer ring 151 such that the recess 347 corresponds in location to the light-generating unit 32 to thereby receive the light-generating unit 32 therein. Subsequently, the base 31 is assembled to the bottom wall 13 of the bottle body 1. Finally, the lid 2 is engaged with the bottle body 1. In use, a switch (not shown) can be electrically coupled to the lighting assembly 3 to selectively activate the light-emitting elements 322 for providing an illumination function to the luminous water bottle. Due to the construction of the illumination member 34, when the light-emitting elements 322 illuminate, light disperses through the bottle body 1 and as a result, the water bottle is illuminated to provide a decorative effect. If the water bottle is used in the dark, it can be used as a torch. Such illumination of the water bottle can also be effectively employed for other purposes, such as a nighttime warning light for traffic safety or a personal nighttime warning light used when walking outdoors.

Figure 3:
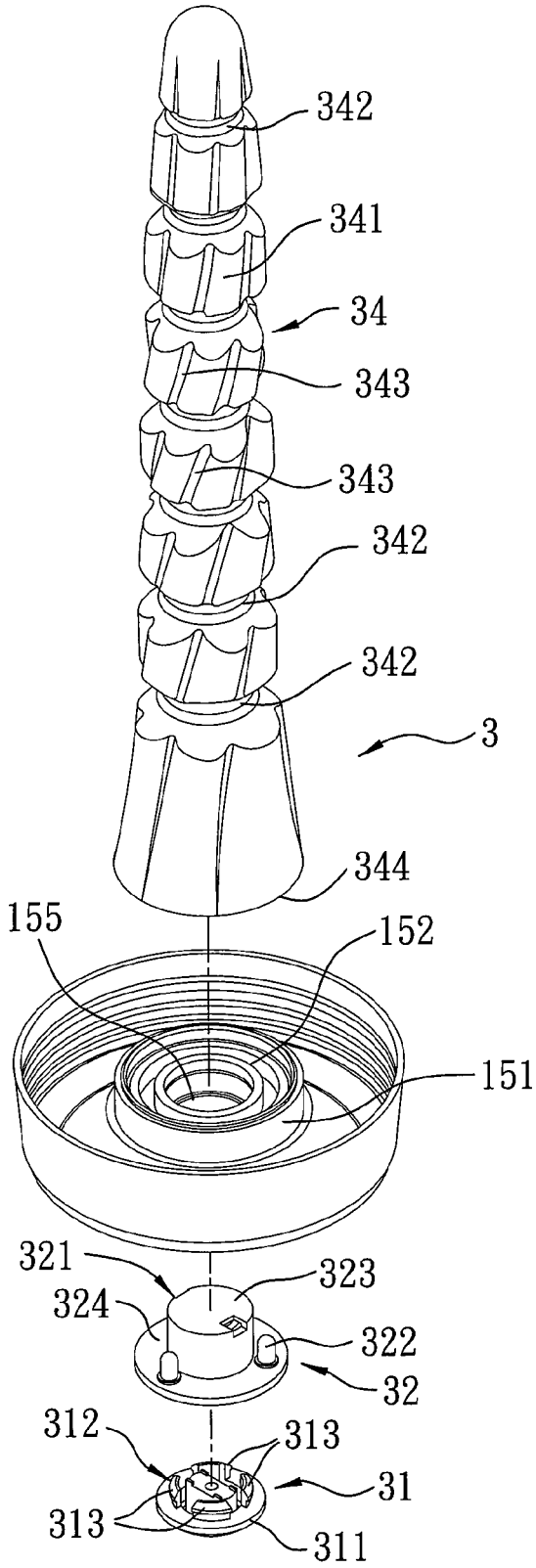
FIG. 3 is an exploded perspective view of a light assembly of the preferred embodiment.

Referring to FIG. 3, it is to be noted that the light-guiding surface 342 of the illumination member 34 may be specially coated to have a frosted-like appearance. The angular formations between the light-guiding surface 342 and the light-emanating surface 341 in combination with the frosted-like coating of the light-guiding surface 342 permit the illumination member 34 to disperse and intensify the light emitted by the light-emitting elements 322. It should be noted that the construction of the light-guiding surface 342 is not limited to that described above. For example, the frosted-like appearance can also be provided surfaces of the cutouts 343. Also, the light-guiding surface 342 does not need to be radially and smoothly indented as shown and described above and instead, can have other forms, such as shapes that are angled. In other words, as long as the light-guiding surface 342 can achieve a light-guiding function, any design can be utilized.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A luminous water bottle comprising:

a bottle body including a bottom wall, and a surrounding wall extending upwardly from a periphery of said bottom wall and cooperating with said bottom wall to define a space, said surrounding wall having an upper end opposite to said bottom wall;

a lid releasably engaged with said upper end of said surrounding wall; and a lighting assembly disposed at least partially in said space and including a light-generating unit for generating and emitting light, and an illumination member for dispersing the light emitted by said light-generating unit;

wherein said bottom wall of said bottle body includes an outer ring extending upwardly from an inner surface of said bottom wall into said space, said outer ring having a stepped configuration to thereby form a ridge on which said light-generating unit is disposed;

wherein said bottom wall of said bottle body further includes an inner ring extending upwardly from said inner surface of said bottom wall into said space and surrounded coaxially by said outer ring, said inner ring defining a through-hole, said light-generating unit including a support, and a light-emitting element disposed on said support, said support having a container with a lower end extending into said through-hole, and a flange that is protruding radially from said container, that is seated on said ridge, and on which said light-emitting element is disposed.

2. The luminous water bottle of claim 1, wherein said illumination member has a light-emanating surface that is recessed to form a light-guiding surface, said light-guiding surface guiding the light emitted by said light-generating unit.

3. The luminous water bottle of claim 1, wherein said lighting assembly further includes a base assembled to said bottom wall of said bottle body, said base including a cover portion disposed under said inner ring, and a connecting portion projecting upwardly from said cover portion and into said through-hole.

4. The luminous water bottle of claim 1, wherein said outer ring of said bottom wall of said bottle body has an upper surface, and said illumination member has a bottom surface, one of said upper surface of said outer ring and said bottom surface of said illumination member being formed with a tongue and the other of said upper surface of said outer ring and said bottom surface of said illumination member being formed with a groove that engages said tongue.

5. The luminous water bottle of claim 4, wherein said illumination member further includes a hole-defining wall extending upwardly from said bottom surface thereof to define a recess for receiving said light-generating unit.

6. The luminous water bottle of claim 1, further comprising a power source unit electrically coupled to said light-generating unit to supply power thereto.

7. The luminous water bottle of claim 6, wherein said container of said support defines a cavity in which said power source unit is disposed, said support further having a flange protruding radially from said container and on which said light-emitting element is disposed.

8. The luminous water bottle of claim 1, wherein said lid includes a cap portion releasably engaged with said bottle body, and a spigot disposed on said cap portion and selectively operable to allow fluid to flow therethrough.

* * * * *